US005576154A

United States Patent [19]

Mussig-Pabst et al.

[11] Patent Number: 5,576,154

[45] Date of Patent: Nov. 19, 1996

[54] PHOTOGRAPHIC RECORDING MATERIALS FOR MEDICAL RADIOGRAPHY

[75] Inventors: Thomas Müssig-Pabst, Frankfurt am Main; Alfred Wörsching, Rodgau-Jügesheim, both of Germany

[73] Assignee: Sterling Diagnostic Imaging, Inc., Glasgow, Del.

[21] Appl. No.: 493,734

[22] Filed: Jun. 22, 1995

[30] Foreign Application Priority Data

Jun. 28, 1994 [DE] Germany ..... 44 22 181.9

[51] Int. Cl.[6] ..... G03C 1/46

[52] U.S. Cl. ..... 430/502; 430/599; 430/600; 430/607; 430/611; 430/581; 430/583; 430/585; 430/511; 430/966

[58] Field of Search ..... 430/502, 599, 430/600, 607, 611, 581, 583, 585, 511, 966

[56] References Cited

U.S. PATENT DOCUMENTS

| | | | |
|---|---|---|---|
| 2,449,153 | 9/1948 | Urbach | 95/7 |
| 2,860,976 | 11/1958 | Spath | 96/22 |
| 3,184,313 | 5/1965 | Rees et al. | 96/101 |
| 3,565,625 | 2/1971 | Scavron | 96/97 |
| 3,708,302 | 1/1973 | Plakunov et al. | 96/107 |
| 3,809,906 | 5/1974 | Van Doorselear | 430/363 |
| 4,230,796 | 10/1980 | Gunther et al. | 430/523 |
| 4,243,748 | 1/1981 | Elsner et al. | 430/600 |
| 4,268,620 | 5/1981 | Iytaka et al. | 430/403 |
| 4,689,292 | 8/1987 | Metoki et al. | 430/567 |
| 4,777,125 | 10/1988 | Delfino et al. | 430/523 |
| 5,380,636 | 1/1995 | Malfatto et al. | 430/966 |

FOREIGN PATENT DOCUMENTS

| | | |
|---|---|---|
| 0264788A2 | 4/1988 | European Pat. Off. . |
| 0533033A1 | 3/1993 | European Pat. Off. . |
| 0581065A1 | 2/1994 | European Pat. Off. . |
| 1208188 | 12/1965 | Germany . |
| 1597496 | 5/1970 | Germany . |
| 1387654 | 3/1975 | United Kingdom . |

*Primary Examiner*—Geraldine Letscher

[57] ABSTRACT

The invention involves a process for making photographic recording materials for radiography having comparable sensitivity and high visual resolution in the resulting x-ray images, whether used with green-emitting or blue-emitting intensifying screens. The invention also describes a process for making x-ray images by the use of such recording materials. The invention regulates the ratio of the silver halide coating's blue to green sensitivity by the addition of an aliphatic 2-amino-1-thio compound of Formula I:

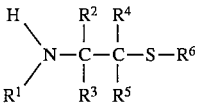

Formula I wherein $R^1$=alkyl of 1 to 5 carbons, aryl, alkylacyl of 1 to 5 carbons, H or arylacyl;

$R^2$, $R^3$, $R^4$, $R^5$=H, alkyl of 1 to 4 carbons or $COR^7$;

$R^6$=H or alkyl of 1 to 5 carbons, $R^7$=OH, $NHR^8$, or O-$R^{10}$ where $R^{10}$ is an alkyl of 1 to 5 carbons;

R8, R9=H or alkyl of 1 to 5 carbons;

$R^1$ and $R^6$ taken together represent one to three methylene groups bridging the nitrogen and the sulfur; and $R^1$ and $R^6$ can be replaced by cyclization between the nitrogen atom and the sulfur atom involving one to three optionally substituted methylene groups.

5 Claims, No Drawings

PHOTOGRAPHIC RECORDING MATERIALS FOR MEDICAL RADIOGRAPHY

BACKGROUND OF THE INVENTION

1. Field of the Invention

The subject of the invention is a process for making photographic recording materials for medical radiography. Whether used with green-emitting intensifying screens or blue-emitting intensifying screens, these materials are characterized by comparably good photographic and physical properties.

2. Description of Related Art

Medical radiography uses photographic recording materials having at least one radiation-sensitive silver halide emulsion coating on both sides of a support (hereinafter designated as x-ray films) in combination with intensifying screens. Intensifying screens contain calcium tungstate or rare earth phosphors, and depending on their composition, emit light of certain wavelengths when irradiated with x-rays. Therefore, the x-ray films must be sensitive in the range of these wavelengths.

Rare earth intensifying screens are known to emit essentially either green, blue or ultraviolet light when irradiated with x-rays. The intensification by the screen and its effect on the visual resolution and noise in the resulting x-ray images depend on the composition of the intensifying screens. The intensifying screen's contributions to the system sensitivity and to the visual resolution in the corresponding x-ray film/intensifying screen system are related inversely. A classification of intensifying screen sensitivities and relative film sensitivities is given in "Image Quality in X-ray Diagnostics" ("Bildqualitat in der Roentgendiagnostik"), by H. S. Stender and F. E. Stieve, Deutscher Aerzte-Verlag Koeln, 1990, pages 168–175. Spectral sensitivity S of a film/screen combination is determined by the exposure $K_s$, measured in mGy, required to achieve a film density of 1.0 above fog:

$$S=K_0/K_s \text{ with } K_0=1 \text{ mGy.}$$

Based on the sensitivity thus obtained, the film/screen combination is conventionally assigned to a sensitivity class. Common sensitivity classes are 50, 100, 200, 400, and 800. A certain film/screen combination is assigned to the class wherein the sensitivity is closest to the class sensitivity. For example, any film/screen combination with a sensitivity of 301 to 600 would be assigned to the sensitivity class 400.

Commercial x-ray films are classified in accordance to their relative speed when exposed to blue or red light, respectively, as half, standard, or double speed films or to relative film speed classes of 0.5, 1.0, or 2.0.

Commercial intensifying screens are also assigned to speed classes such as 50, 100, 200, 400, and 800, in accordance with their contribution to system sensitivity S.

The system sensitivity class of a given film/screen combination can be obtained as the product of the screen speed class number and the relative film speed given in the tables of the Stender et al. publication. For example, the sensitivity class of the system consisting of DuPont Quanta Fast Detail screen and Cronex® 7L is 400*0.5=200.

The physical and photographic properties of the x-ray films together with the composition of the intensifying screens determine the quality of the resulting x-ray images and, thereby, their suitability for accurate medical diagnosis by radiology. The highest possible visual resolution in the x-ray image at the lowest possible patient exposure to radiation is especially desirable. Accordingly, the combination of x-ray film and screens must by very accurately coordinated. The various diagnostic problems for the radiologist usually involve, in practice, the use of different combinations of x-ray film with intensifying screens of various sensitivities and, consequently, various system sensitivities.

The silver halide emulsion for making x-ray films must have the highest possible sensitivity. The expert knows, however, that using the largest possible silver halide grains to attain higher sensitivity has limits, because the quality (resolution and noise) of the x-ray images decreases with increasing size of the silver halide grains.

Many methods are known to improve sensitivity or the ratio of sensitivity to fog in silver halide emulsions. For example, a conventional method is chemical sensitization by chemically ripening with gold and with sulfur. Another method is the so-called reduction sensitization. In addition, other materials are known to affect the sensitometry of silver halide emulsions, for example, 2-amino-ethanethiol-1-hydrochloride or 3-thiazolidine-4-carboxylic acid, as described, for example, in U.S. Pat. No. 2,860,976 and DE-PS 17 72 424.

The sensitivity and gradation of an x-ray film can be determined, for example, according to German Standard DIN 6867 (April 1985) or as described in "Image Quality in X-Ray Diagnostics", by H. S. Stender and F. E. Stieve, Deutscher Aerzte-Verlag Koeln, 1990.

Suitable green-sensitizing dyes and their use in photographic recording materials are known to the expert. Examples are trimethinecyanine dyes, optionally substituted appropriately. Such dyes are described, for example, in EP-A 0 581 065 and EP-A 0 404 142. A general review of the use of chemical and spectral sensitization of photographic silver halide emulsions is presented in Research Disclosure, Vol. 308, Number 308119 (December 1989), Chapter III and IV and the references therein.

Known green-sensitized silver halide recording materials have a significantly higher sensitivity to the light produced by green-emitting intensifying screens than to the light produced by blue-emitting screens. Examples are described in EP-A 0 264 788 and EP-A 0 581 065.

Known blue-sensitive and green-sensitive x-ray films and the corresponding intensifying screens are listed, for example, in "Image Quality in X-Ray Diagnostics", by H. S. Stender and F. E. Stieve, Deutscher Aerzte-Verlag Koeln, 1990, pages 168–174.

The current state of the art has a disadvantage for the radiologist, because in the use of an x-ray film with a certain spectral sensitivity, the selection of a suitable intensifying screen is limited to a group of intensifying screens with the corresponding emission spectrum.

In addition to the invariably high quality requirements on modern x-ray films, rapid availability of the developed x-ray image is also important. Examples are images that are made during an operation and that are supposed to indicate the further course of the operation. In addition, the images must be rapidly available so that the radiologist sees whether the diagnostically significant area has been imaged, while the patient is still under the x-ray camera.

Furthermore, exposed material from many imaging devices, such as, for example, x-ray cameras, laser cameras, apparatus for photographic monitoring, and copy machines for x-ray films are often processed in the same processor in hospitals and large medical practices. Therefore, the highest possible throughput of photographic films and, consequently, the shortest possible processing time of less than 60 seconds are desired in the processor for x-ray films and for other photographic films in those hospitals and medical practices.

The processing time for a photographic film depends decisively on the composition of the film, the structure and mode of operation of the processor, the developer solution used in the processor, and the fixing bath. All parameters, such as, for example, dryer geometry, drying time in the processor, or process water uptake by the film, which affect drying the film in the processor, are especially important.

Processing time is defined as the time that a standard 0.35 m×0.35 m edge length x-ray film requires to pass through the processor, beginning with the insertion of the x-ray film and ending with the complete exit of the developed x-ray image. This time span is designated in the literature as "nose to drop".

A photographic silver halide recording material qualifies as rapidly processible, if it can be processed within 30 to 60 seconds in a film processor. A necessary prerequisite for the recording material is a maximum process water uptake of 20 $g/m^2$.

An example of a roll film developing machine suitable for this processing and a formulation for a developer and fixer bath for the machine are described in EP-A 02 38 271.

SUMMARY OF THE INVENTION

Therefore, the problem involved in the present invention is to provide a process for making x-ray film which has essentially the same sensitivity with the same visual resolution capability and the same noise when used in combination with green-emitting as well as with blue-emitting rare earth intensifying screens, to make the corresponding x-ray film, and to provide a process for making x-ray images. The sensitivity of the combination of the resulting recording material with a blue-emitting rare earth intensifying screen of Sensitivity Class 400 (at relative film speed of 1.0) should be at least 80% in linear units of the sensitivity of the combination of the same recording material with a green-emitting rare earth intensifying screen of Sensitivity Class 200 (at relative film speed of 1.0).

This problem is solved by the process provided in a process for making a photographic recording material for radiography comprising a support with at least one photosensitive silver halide emulsion coated on the support, the process comprising:

a) making a first silver halide emulsion;

b) converting the first silver halide emulsion into a photosensitive silver halide emulsion by:

i) physically ripening the first silver halide emulsion to make a physically ripened silver halide emulsion;

ii) chemically ripening the physically ripened silver halide emulsion with gold and sulfur to make a chemically ripened silver halide emulsion; and iii) adding at least one green-sensitizing dye in a quantity adequate to attain at least 80% of a maximum attainable sensitivity (in linear units) of the chemically ripened silver halide emulsion for light of wavelengths in a range of 470 to 600 nm;

c) making a photoinsensitive solution;

d) adding to at least one of the photoinsensitive solution or the photosensitive silver halide emulsion at least one compound defined by:

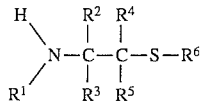

wherein $R^1$ =alkyl of 1 to 5 carbons, aryl, alkylacyl of 1 to 5 carbons, H or arylacyl;

$R^2$, $R^3$, $R^4$, $R^5$=H, alkyl of 1 to 4 carbons or $COR^7$;

$R^6$=H or alkyl of 1 to 5 carbons, $R^7$=OH, $NHR^8$, $NR^8R^9$ or O-$R^{10}$ where $R^{10}$ is an alkyl of 1 to 5 carbons; and R8, R9=H or alkyl of 1 to 5 carbons; or $R^1$ and $R^6$ taken together represent one to three methylene groups bridging the nitrogen and the sulfur;

said compound being added in a quantity adequate to set the maximum attainable sensitivity of a combination of a resulting recording material with a blue-emitting rare earth intensifying screen of Sensitivity Class 400, at a relative film speed of 1.0, at a minimum of 80% in linear units of the maximum attainable sensitivity of the combination of the resulting recording material with a green-emitting rare earth intensifying screen of Sensitivity Class 200, at relative film speed of 1.0; and e) forming the resulting recording material by coating the photosensitive silver halide emulsion and the photoinsensitive solution on the support.

A preferred photographic recording material for radiography is provided in a photographic recording material for radiography, comprising a support and at least one silver halide emulsion coated on the support, characterized in that a difference in sensitivity of the recording material to radiation from blue-emitting intensifying screens and green-emitting intensifying screens is no more than 20% in linear units of the sensitivity to radiation from blue-emitting intensifying screens.

DETAILED DESCRIPTION OF THE INVENTION

It has been found, surprisingly, that the effect of compounds of Formula I on the blue sensitivity of silver halide emulsions is greater than the effect on their green sensitivity. Thus, for example, at a given green sensitivity for a silver halide emulsion, its blue sensitivity can be increased to a desired value by the addition of a compound of Formula I.

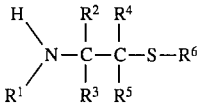

Formula I

In Formula I:

$R^1$ represents alkyl of 1 to 5 carbons, aryl, alkylacyl of 1 to 5 carbons, hydrogen or arylacyl;

$R^2$, $R^3$, $R^4$ and $R^5$ independently represent hydrogen, alkyl of 1 to 4 carbons, or —$COR^7$;

$R^6$ is hydrogen or alkyl of 1 to 5 carbons;

$R^7$ represents OH, $NHR^8$, $NR^8R^9$ or —$OR^{10}$;

$R^8$ and $R^9$ independently represent hydrogen or an alkyl of 1 to 5 carbons; and $R^{10}$ is an alkyl of 1 to 5 carbons; or R1 and R6, taken together, represent one to three methylene groups bridging nitrogen and sulfur.

Examples of suitable aliphatic 2-amino-1-thio compounds of Formula I are cysteine, β-alkyl cysteine, penicillamine and its N-alkyl, N-acylalkyl, N,N-dialkyl, N,N-diacyldialkyl derivatives and/or corresponding esters, such as, for example, cysteine methyl ester, 2-aminoethane-1-thiol, 2-methylamino-ethane-1-thiol, optionally substituted 4-carboxythiazolidines as described, for example, in U.S. Pat. No. 2,860,976 and DE-C 28 44 231, and the corresponding hydrochloride adducts. In this context, alkyl means branched or straight chain, optionally halogen-substituted hydrocarbon chains having up to five carbon atoms. "Aryl" means at least 6 carbons in an aromatic ring and preferably 6 to 24 carbons in an aromatic ring or fused aromatic ring. "Arylacyl" means at least 7 carbons and preferably 7 to 25 carbons. Examples of such additives for photographic recording materials are described in U.S. Pat. No. 2,860,976, U.S. Pat. No. 2,449,153, DOS 23 35 093, DE-C 28 44 231, and DPS 17 72 424.

Cysteine is especially preferred in a quantity of 1 mg to 50 mg per mole of silver halide.

Cysteine used alone or in combination with 3-thiazolidine-4-carboxylic acid is used in a particularly preferred process. The use of cysteine with a combination of 3-thiazolidine-4-carboxylic acid and bis-(5-mercapto-1,2,3-thiadiazolyl-2-) disulfide, as described, for example, in DE-C 28 44 231, is especially preferred. Particularly preferred is the use of this combination at 0.1 mg to 100 mg of 3-thiazolidine-4-carboxylic acid per mole of silver halide and 0.1 mg to 100 mg of bis-(5-mercapto-1,2,3-thiadiazolyl-2-) disulfide per mole of silver halide.

The photographic emulsions can be made by various methods from soluble silver salts and soluble halides.

Metal ions, such as, for example, cadmium, zinc, thallium, mercury, iridium, rhodium, iron, and its complexes can be added during the preparation and/or physical ripening of the silver halide emulsion. During physical ripening, or Ostwald ripening, the smaller crystals of silver halide are allowed to dissolve and are redeposited onto the larger crystals of silver halide.

The silver halide emulsion can contain silver halide crystals comprising silver bromide, silver bromoiodide, silver chlorobromoiodide, or silver chlorobromide. A preferred silver halide emulsion contains silver bromoiodide with a maximum proportion of 3% iodide, relative to the halogen proportion.

After crystal formation is complete or even at an earlier point, the soluble salts are removed from the emulsion, for example, by making and washing noodles, by flocculation and washing, by ultrafiltration, or by ion exchange.

The silver halide is generally sensitized chemically under defined conditions of pH, pAg, temperature, gelatin concentration, silver halide concentration, and sensitizer concentration to attain optimum sensitivity and fog. The chemical sensitizers used are, for example, active gelatin, sulfur compounds, selenium compounds, tellurium compounds, salts or complexes of gold, platinum, rhodium, palladium, iridium, osmium, rhenium, ruthenium, alone or in combinations. Process methods are described, for example, by H. Frieser in "The Fundamentals of Photographic Processes with Silver Halides" ("Die Grundlagen der Photographischen Prozesse mit Silberhalogeniden"), pages 675–734, Akademische Verlagsgesellschaft (1968) and by T. H. James, "The Theory of the Photographic Process", 4th edition, Macmillan Publishing Co., Inc., New York, pages 149–160 and in the references cited therein.

In a preferred embodiment of the invention's process, a compound suitable for reduction sensitization is also added to the silver halide emulsion during preparation. The term "reduction sensitization" means here that a reducing agent is added to the emulsion, and thereby, the photosensitivity of the silver halide emulsion is increased. The addition can be made at any time during the preparation, thus, for example, during as well as before the precipitation of the silver halide and during or after chemical ripening. Examples of suitable reducing agents are zinc (II) chloride, hydrazine and certain hydrazine derivatives, glutardialdehyde, glutardialdehyde bisulfite, formamidine sulfinic acid, thiourea dioxide, silanes, ascorbic acid and comparable reducing sugars, polyamines, such as, for example, dimethylenetriamine or spermine, and boranes, such as, for example, dimethylaminoborane. Reduction sensitization can also be accomplished by treating the emulsion with gaseous hydrogen or by digesting the emulsion with a silver ion excess.

The amount of reduction sensitization reagent to use depends greatly on the preparation process for the silver halide and generally is between 0.3 and 300 mg per mole of silver halide.

Dialdehydes and/or their bisulfite adducts are preferred. Addition during chemical ripening of the silver halide emulsion is particularly preferred.

Examples of suitable dialdehydes are glutardialdehyde, 2-methylglutardialdehyde, 3-methylglutardialdehyde, other mono and oligoalkyl substituted glutardialdehydes and their corresponding bisulfites. Such use to increase sensitivity is described, for example, in DE-C 29 29 247. Glutardialdehyde and/or glutardialdehyde bisulfite are preferred. Combinations of more than one dialdehyde and/or dialdehyde bisulfite can also be used. A quantity of 0.3 to 300 mg of glutardialdehyde bisulfite per mole of silver halide is especially preferred.

To stabilize the emulsion against fog formation or to stabilize other photographic properties, the layers of the photographic recording material can contain compounds, such as, for example, bromides, benzothiazolium salts, nitroindazoles, nitrobenzimidazoles, mercaptothiazoles, mercaptobenzothiazoles, mercaptobenzimidazoles, mercaptothiadiazoles, chlorobenz-imidazoles, bromobenzimidazoles, aminotriazoles, benzotriazoles, nitrobenzotriazoles, mercaptopyrimidines, mercaptotriazines, thioketo compounds, such as, for example, oxazolinthione, azaindolizines, such as triazaindolizines, and tetraaza-indolizines, such as the especially preferred 5-hydroxy-7-methyl-1,3,4-triazaindolizine, and mercaptotetrazoles, such as, for example, 1-phenyl-5-mercaptotetrazole either alone or combined with other compounds of this group.

The layers having the hydrophilic binders can contain organic or inorganic hardeners for preparing the invention's photographic silver halide recording materials. A layer can also be hardened by overcoating it with a layer containing a diffusible hardener, such as described, for example, in DE-A 38 36 945. The hardener can be added during the preparation of the emulsion solutions and/or coating solutions for auxiliary layers. Another possible method of addition is to inject a solution of the hardener into at least one emulsion or coating solution during its transport from the supply kettle to the coater. Examples of suitable solvents are water and water-miscible organic solvents, such as ethanol, acetone, dimethyl sulfoxide, or 1,4-dioxane.

The hardener solution can be stabilized by the addition of compounds or mixtures of compounds that set the pH value of the hardener solution and/or buffer it. An example (borate buffer) is described in DE-C 28 20 108.

Examples of such hardeners used in photographic recording materials are chromium salts, such as chrome alum, aldehydes, such as formaldehyde, glyoxal, and glutardialdehyde, N-methylol compounds, such as N,N'-dimethylolurea, compounds bearing reactive vinyl groups, such as 1,3-bis-(vinylsulfonyl)-2-propanol, bis-(vinylsulfonyl)methyl ether, N,N',N''-trisacryloylhexahydrotriazine, polymeric hardeners as described, for example, in DE-C 32 23 621, 1,3-bis-carbamoylimidazolium compounds as described in DE-B 41 19 982, or carbamoyl pyrimidinium compounds as described, for example, in DE-C 23 17 677. Two or more hardeners can also be used together. A preferred embodiment uses at least some formaldehyde as hardener. At least 20 mole percent formaldehyde, relative to the total hardener quantity, is especially preferred.

Spectral sensitization is defined as a broadening of the useful sensitivity range of silver halide emulsions and silver halide emulsion coatings to greater wavelengths by treating the silver halide crystals with dyes absorbing light of these wavelengths and making them useful for forming the latent image.

Silver halide emulsions have an inherent sensitivity to blue radiation defined as 380–470 nm. This sensitivity to blue radiation is enhanced by chemical ripening.

The maximum attainable green sensitization of a silver halide emulsion containing at least one green-sensitizing dye is reached when further addition of a green-sensitizing dye does not increase sensitivity.

One skilled in this art is familiar with spectral sensitizers for green-sensitized, silver halide recording materials and the quantities to be used. Such sensitizers increase the sensitivity of silver halide emulsions to light in the range of 470 to 600 nm. The quantity of green-sensitizing dye or dye combination required to reach maximum attainable sensitization of the silver halide emulsion in the absorption spectrum of the dye can be determined easily by appropriate experimentation.

Examples of spectral sensitizers in the silver halide emulsion can include cyanine, merocyanine, oxonol, hemioxonol, hemicyanine, and styryl dyes. A spectral sensitizer can be used alone or in a combination. Such spectral sensitizers or sensitizer combinations are conventionally used in a quantity of 50 mg to 3 g per mole of silver halide. Green sensitizer dyes used in a preferred embodiment are Formula II and III either alone or in combination.

Formula II

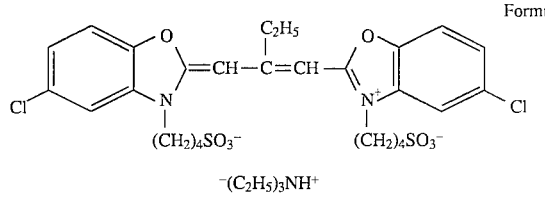

Formula III

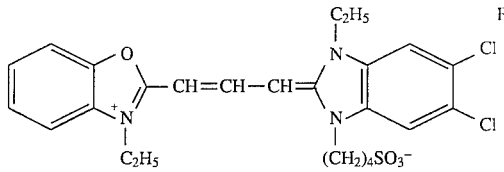

The photographic recording material can be coated on one or both sides with one or more silver halide emulsion layers. A preferred form of the photographic recording material contains at least one silver halide emulsion layer on each of both sides of the support.

A preferred hardener quantity results in the silver halide recording material absorbing less than 20 grams of processing water per square meter of material and thus qualifying for rapid processing. Especially preferred is a hardener quantity that yields a processing water uptake of less than 16 $g/m^2$ of the silver halide recording materials. One skilled in this art knows how to determine the required hardener quantity.

The silver coating weight is the weight of silver in the form of its ions in the layers containing silver halide crystals, relative to the unit area of the photographic silver halide material. Values for silver coating weight are stated in grams/square meter, relative to the sum of all layers containing silver halide on the recording material.

The silver coating weight usually is in the range between 2.5 $g/m^2$ and 8 $g/m^2$. A preferred embodiment of the photographic silver halide recording material has a silver coating weight of at least 4.9 $g/m^2$. A silver coating weight of at least 5.3 $g/m^2$ is especially preferred.

A preferred embodiment for preparing the silver halide emulsion has a binder to silver ratio so selected that the resulting silver halide emulsion layer has a value for a parameter W as follows:

$W=Ng/(N_s*N_m)$ which is greater than (0.50−Ar/1000)

wherein

Ng=the total number of silver halide crystals per unit area, $N_s$=the number of individual layers in the silver halide emulsion coating, Nm=the maximum number of silver halide crystals in the silver halide emulsion coating that an individual layer can contain, and Ar=the percent by weight proportion of tabular silver halide crystals relative to total silver halide in this silver halide emulsion coating.

The silver halide crystals in the silver halide emulsion can have a regular crystal shape, such as, for example, cubic, octahedral or cuboctahedral, or a less regular shape, such as tabular, single twin with (111) and/or (100) boundary faces, or spherical. Furthermore, the silver halide emulsions can contain mixtures of at least two of these crystal shapes.

Such silver halide crystals are considered to be elliptical if the average ratio of the smallest dimension to the largest dimension (aspect ratio) is between 1.0:1.1 and 1.0:2.0. Examples of such silver halide crystals are cubes, octahedra, cuboctahedra, and single twins with (111) and/or (100) boundary faces.

Spherical silver halide crystals have a smallest to largest dimension ratio between 1.0:1.1 and 1.0:1.0. Tabular silver halide crystals have an aspect ratio of at least 1.0:2.0.

The average grain diameter of a spherical or elliptical silver halide emulsion is the diameter of a sphere equal to the average grain volume. Thus, different grain shapes, which constitute elliptical silver halide crystals, such as cubes, single twins with (111) and/or (100) boundary faces, or octahedra can be compared just as suitably with each other as with spherical silver halide crystals.

Average grain volumes of 0.08 $\mu m^3$ to 0.40 $\mu m^3$ are preferred in using spherical or elliptical silver halide emulsions. Silver halide emulsions of spherical silver halide crystals are especially preferred.

Preferred tabular silver halide emulsions have silver halide crystals with an average grain diameter between 0.8 μm and 2.0 μm and an average ratio of grain diameter to grain thickness between 2:1 and 7:1. For this purpose, the average grain diameter of tabular silver halide emulsions is defined as the diameter of a circle having an area equal to the area of an average tabular face.

The average grain diameter of a silver halide emulsion can be measured by different methods, such as, for example, electron microscopy of the appropriate emulsion. The average grain volume of a silver halide emulsion can be measured by the method described in DE 20 25 147.

The thickness of the emulsion layer of a photographic recording material is controlled by the silver coating weight and the quantity of binder in the silver halide emulsion. It can be measured, for example, by electron microscopy of a cross-section of the recording material.

The thickness of the individual layer of an emulsion coating is defined as equal to the diameter of a sphere equal to the average grain volume of the corresponding spherical or elliptical silver halide emulsion or equal to the grain thickness in using tabular silver halide emulsions. If the emulsion is a mixture of at least two spherical and/or elliptical silver halide emulsions, the thickness of the individual layer is defined correspondingly as equal to the diameter of a sphere equal to the average grain volume of the corresponding spherical and/or elliptical silver halide emulsion.

If a mixture of at least one spherical or elliptical silver halide emulsion and at least one tabular silver halide emulsion is used, the thickness of the individual layer is obtained from the sum of the average grain thickness of the tabular silver halide emulsion or emulsions and the average diameter of a sphere equal to the average grain volume of the corresponding spherical and/or elliptical silver halide emulsion or emulsions, in each case multiplied with the value of the percent by weight proportion and divided by 100.

In such a silver halide emulsion, the smallest possible value useful in the invention for the parameter W depends on the weight ratio between tabular and spherical and/or elliptical silver halide grains.

The number of individual layers in a silver halide emulsion coating $N_s$ is defined as the quotient of the thickness of the silver halide emulsion coating and the thickness of the individual layer.

The total number of silver halide grains per unit area $N_g$ is defined as the silver halide coating weight per unit area divided by the product of the average grain volume and the density of the silver halide grains.

The maximum possible number of silver halide crystals in the silver halide emulsion coating $N_m$, which can be contained in a unit area of the individual layer, is defined as the number of silver halide crystals, the projection surfaces of which together equal the surface of the corresponding unit area. In the case of tabular silver halide crystals, the average, largest possible projection surface of the silver halide crystals is used to calculate $N_m$.

The projection surface of silver halide emulsion grains can be determined, for example, by measuring images of such emulsions by electron microscopy. To calculate $N_m$ for spherical or elliptical silver halide emulsions, a circular area having the average grain diameter of the emulsion can be assumed as an approximation for the average projection surface.

The binder coating weight for the silver halide emulsion coating is between 0.5 $g/m^2$ and 5.0 $g/m^2$, for protective layers between 0.5 $g/m^2$ and 2.0 $g/m^2$, and for intermediate layers between 0.1 $g/m^2$ and 2.0 $g/m^2$.

The preferred coating weight for hydrophilic binders in the invention's silver halide emulsion coating is between 0.35 and 0.75 for the weight ratio of the coating weight of the hydrophilic binder in the silver halide emulsion coating, in which the parameter W has the typical value, to the silver coating weight of the same silver halide emulsion coating.

The photographic silver halide recording material can bear one or more different layers on both sides of the substrate, such as, for example, bonding layers, protective layers, intermediate layers, emulsion layers, antistatic layers, and layers containing dyes.

The protective layer, or photoinsensitive layer, is the one farthest from the support and without silver halide. Such layers contain optionally, in addition to hydrophilic binders and surfactants, other compounds that affect the chemical, physical, and mechanical properties of the x-ray film. Examples are slip agents, surfactants containing perfluoroalkyl groups, latexes (organic polymer particles), finely divided crystalline $SiO_2$ dispersions, matte agents (spacers), hardeners, antistats, and preservatives.

The preferred protective colloid for silver halide crystals in the emulsion coating and for the hydrophilic binder is alkaline-digested gelatin from cattle bones. This can be treated by ion exchange.

In addition, other binders can also be used in the various layers of the silver halide recording material. Examples of hydrophilic binders are synthetic polymers, such as polymers or copolymers of vinyl alcohol, N-vinyl pyrrolidone, acrylamide, acrylic acid, methacrylic acid, vinyl imidazole, vinyl pyrazole, natural polymers, such as casein, gelatin (acid-digested or alkaline-digested, prepared from cattle bones or pigskins), cellulose and cellulose derivatives, alginates, albumin, starch, modified polymers, such as hydroxyethyl cellulose, hydrolyzed gelatin, chemically modified gelatin such as described, for example, in EP-A 03 75 522, and chemically modified and hydrolyzed gelatin, such as described, for example, in DE-B 21 66 605 and U.S. Pat. No. 3,837,861.

The hydrophilic binder in the photographic silver halide recording material can be contained in the emulsion layers and in auxiliary layers, such as, for example, protective layers, bonding layers, or intermediate layers.

Other binders, in addition to the hydrophilic binders, can be used in the coatings on the photographic recording material. Examples of such binders are matte agents or latexes (organic polymer particles) that are coated as aqueous dispersions usually stabilized by wetting agents in the corresponding coating solution.

Surfactants can be used for various purposes in the silver halide emulsion and in the mixtures for making bonding layers, for example, as coating aids, to prevent electrostatic accumulation, to improve slip properties, to emulsify the dispersion, to prevent adhesion, and to improve photographic characteristics (for example, accelerated development, higher contrast, sensitization).

Besides natural surfactants, such as, for example, saponin, the synthetic surfactants mainly used are nonionic surfactants containing oligo or polyoxyalkylene groups, glycerin compounds, glycidol compounds, cationic surfactants, for example, higher alkyl amines, quaternary ammonium salts, pyridine compounds, and other heterocyclic compounds, sulphonium compounds, phosphonium compounds, anionic surfactants containing an acid group, for example, carboxylic, phosphoric, or sulfuric acid, ampholytic surfactants, such as, for example, amino acid compounds, amino sulfonic acid compounds, and sulfuric and phosphoric acid esters of an amino alcohol.

The layers of the photographic recording material can contain filtering dyes, such as oxonol, hemioxonol, styryl, merocyanine, anthraquinone, cyanine, azomethine, triarylmethane, phthalocyanine, and azo dyes.

The support for the photographic recording material can be a transparent or optionally, blue-dyed synthetic resin sheet. This sheet can be made, for example, from synthetic resins, such as polyethylene terephthalate, cellulose acetate, cellulose acetate butyrate, polystyrene, or polycarbonate.

The surface of the support is preferably treated by corona discharge to improve adhesion properties, preferably before a first coating.

Various coating processes can be used to make the photographic recording material. Examples are curtain coating, cascade coating, dip coating, extrusion coating, and bar coating. More than one layer can be coated simultaneously, if desired.

A general review of photographic silver halide emulsions, their preparation, additives, processing, and use is given in Research Disclosure, Vol. 308, No. 308119 (December 1989) and in the references cited therein. (Research Disclosure is published by Kenneth Mason Publications, Ltd., Dudley Annex, 21a North Street, Elmsworth, Hampshire P010 7DQ, England.)

The invention's photographic silver halide recording material has higher resolution, better image color (bluer silver image), improved mechanical stability in the emulsion layer, and lower noise than current state-of-the art products.

In a preferred embodiment of the invention, the photographic silver halide recording material is processed rapidly in a suitable roll processor.

Another preferred embodiment of the invention's photographic silver halide recording material for medical radiography shows advantageously comparable sensitometry whether processed rapidly or in 90 seconds.

Another advantage of the invention's photographic recording material for medical radiography is high visual resolution of the resulting x-ray images at high sensitivity in the recording material.

X-ray films that show essentially the same sensitivity with the same visual resolution capability in combination with green-emitting or blue-emitting intensifying screens at the same system sensitivities are advantageously more economical to make than a corresponding x-ray film line comprising blue-sensitive x-ray films and green-sensitive x-ray films. Savings are especially possible from a reduced number of emulsion batches and product changes and from simplified finishing.

Another advantage of the invention's photographic silver halide recording material for medical radiography is the extensive independence of gradation in the resulting x-ray images from the wavelengths of the light emitted by the intensifying screens.

EXAMPLES

Silver halide emulsions No. 1 to 5 and 11 were made with spherical silver bromoiodide grains containing 2% iodide and the average grain volume V(50) given in Table 1. These silver halide emulsions were washed and then subjected to gold and sulfur ripening as usual for photographic silver halide emulsions. During the chemical ripening, the quantities of glutardialdehyde bisulfite (GDABS) shown in Table 1 were added. At the end of the chemical ripening, the quantities shown in Table 1 of 3-thiazolidine-4-carboxylic acid (TCA), cysteine, and bis-(5-mercapto-1,2,3-thiadiazolyl-2-)disulfide (BMTD) were added to stabilize the emulsion. A combination of Formula II and Formula III was added in a weight ratio of 1:5.6 as a sensitizer system. In each case, one of the emulsions was coated together with a mixture to make a protective layer having formaldehyde hardener on both sides of a blue-tinted substrate of polyethylene terephthalate provided with a bonding layer and dried, so that the silver coating weight attained the values given in Table 1 in grams per square meter, the processing water uptake (PWP) attained the values given in Table 1, and the area weight of gelatin in the protective layer was 1.2 grams per square meter. The quantities shown in the table for GDBAS, cysteine, TCA, and BMTD are each relative to 1 mole of silver.

The processing water uptake (PWP) of the film samples was determined by exposing overall a sheet of the recording material to be tested at an exposure corresponding to the saturation region of the density curve. The sample was processed by the RP process (90 second throughput; developer bath temperature 34° C.) in a roll processor (Kodak Processor, Type MS), with the rear cover and the upper reversal spindle behind the wash area removed, charged with a developer solution and a fixing bath of the following compositions:

| | g/l |
|---|---|
| **Developer** | |
| Hydroquinone | 24.0 |
| 1-phenyl-3-pyrazolidone | 0.75 |
| Sodium sulfite, anhydrous | 60.0 |
| Sodium metaborate | 33.0 |
| Sodium hydroxide | 19.0 |
| Potassium bromide | 10.0 |
| 6-nitrobenzimidazole | 0.5 |
| Disodium salt of Ethylene diamine tetracetic acid | 3.5 |
| Glutaraldehyde sodium bisulfite | 15.0 |
| Water to make | 1 liter |
| **Fixer bath** | |
| Ammonium thiosulfate | 130.0 |
| Sodium sulfite, anhydrous | 10.0 |
| Boric acid | 7.0 |
| Acetic acid (90% by weight) | 5.5 |
| Sodium acetate trihydrate | 25.0 |
| Aluminum sulfate · 18 H2O | 9.0 |
| Sulfuric acid (60% by weight) | 5.0 |
| Water to make | 1 liter |

The samples were removed directly after being washed, weighed wet, dried, and weighed dry. The weight difference divided by the area is shown as the process water uptake (PWP) of the recording material in grams of water per square meter of film.

In addition to the comparison films and the invention's films, five commercial, known, green-sensitized photographic silver halide recording materials for radiography were tested (No. 6 to 10).

TABLE 1

| | GDABS | Cysteine | TCA | BMTD | Dye | | AgX Grain | | PWP |
|---|---|---|---|---|---|---|---|---|---|
| No. | g/mole Ag | | | | | CW | Shape | V50 | g/m2 |
| 1 | 0.067 | 0.010 | — | — | 0.24 | 5.4 | S | 0.11 | 16 |
| 2 | 0.133 | 0.012 | 0.008 | 0.0067 | 0.24 | 5.4 | S | 0.11 | 16 |
| 3 | 0.067 | 0.010 | — | — | 0.24 | 5.4 | S | 0.09 | 15 |
| 4 | 0.133 | 0.012 | 0.008 | 0.0067 | 0.24 | 5.4 | S | 0.09 | 15 |
| 5 | 4.00 | 0.012 | 0.016 | 0.0080 | 0.20 | 5.8 | S | 0.22 | 14 |
| 6 | U | U | U | U | U | 4.7 | S | 0.125 | 14 |
| 7 | U | U | U | U | U | 4.4 | T | 0.23 | 15 |
| 8 | U | U | U | U | U | 4.4 | T | 0.26 | 15 |
| 9 | U | U | U | U | U | 3.8 | T | 0.09 | 16 |
| 10 | U | U | U | U | U | 4.7 | T | 0.14 | 27 |
| 11 | 1.33 | 0.012 | 0.016 | 0.0080 | 0.0 | 4.4 | S | 0.09 | 24 |

"S" means spherical or elliptical silver halide crystals.
"T" means tabular silver halide crystals.
"U" means "Unknown".
"CW" is silver coating weight in $g/m^2$.
V50 is average grain volume in $\mu m^3$.
The dye is listed as g/mole of Ag.

Table 2 shows the sensitometric data for the logarithmic (to the base 10) sensitivity and gradation, as well as the visual resolution, the layer thickness S of the silver halide emulsion coating and the values for the parameter W of the invention's photographic recording materials "I" and of the comparison materials "C". Gradation was measured between densities 1 and 2 over fog. Sensitivity was measured at density 1 over fog. The sensitivity to light from the green-emitting intensifying screens was measured with screens containing $Gd_2O_2S$ doped with terbium ("Lanex Medium", Eastman Kodak; sensitivity class 200), using an aluminum 30-step wedge and a wedge constant of 0.1. The sensitivity is shown in logarithmic units in Table 2 under "Green". The blue sensitivity was measured correspondingly with blue-emitting intensifying screens containing $YTaO_4$ activated with niobium ("Quanta Fast Detail, Du Pont"; sensitivity class 400). The difference in sensitivities is shown in Table 2 under "Δ%" in linear units, the green sensitivity being set at 100% in each case.

Visual resolution was measured by exposing through a lead bar target using the above-cited blue-emitting intensifying screen on the corresponding x-ray film and visual evaluation of the developed x-ray image. The lead bar target was a conventional test pattern consisting of a lead foil (50 μm thick) with cut-out bar like windows having different widths and distances.

TABLE 2

| | Sensitivity | | | Gradation | | Resolution | S | | |
|---|---|---|---|---|---|---|---|---|---|
| No. | Green | Blue | Δ% | Green | Blue | l/mm | mm | W | I/C |
| 1 | 16.3 | 15.7 | 33.9 | 95 | 103 | 5.7 | 2.9 | 0.68 | C |
| 2 | 16.6 | 16.3 | 18.7 | 105 | 103 | 5.7 | 2.9 | 0.68 | I |
| 3 | 16.1 | 15.3 | 42.5 | 95 | 100 | 5.7 | 2.9 | 0.65 | C |
| 4 | 16.2 | 15.9 | 18.7 | 100 | 100 | 5.7 | 2.9 | 0.65 | I |
| 5 | 17.4 | 17.1 | 18.7 | 115 | 110 | 5.0 | 3.1 | 0.47 | I |
| 6 | 16.7 | 16.0 | 38.3 | 80 | 80 | 4.5 | 3.3 | 0.47 | C |
| 7 | 16.3 | 15.5 | 42.5 | 115 | 130 | 4.5 | 3.6 | 0.27 | C |
| 8 | 16.6 | 15.5 | 53.2 | 95 | 105 | 4.5 | 3.7 | 0.27 | C |
| 9 | 16.4 | 15.3 | 53.2 | 110 | 125 | 5.0 | 3.0 | 0.31 | C |
| 10 | 17.3 | 16.5 | 42.5 | 90 | 80 | 4.0 | 4.0 | 0.38 | C |
| 11 | n.m. | 16.3 | n.m. | nm. | 100 | 5.3 | 3.3 | 0.46 | C |

"n.m." means not measurable, because not green-sensitized.
"C" means comparative.
"I" means inventive.

Sensitivities to blue-emitting intensifying screens and green-emitting screens are comparable when the sensitivity difference A% is no more than 20%.

What is claimed is:

1. Photographic recording material for radiography, comprising a support and at least one silver halide emulsion layer coated on said support, characterized in that a difference in sensitivity of the recording material to blue radiation and green radiation is no more than 20% in linear units of the sensitivity to blue radiation and said photographic recording material comprises 0.3 to 300 mg per mole of silver halide of the compound defined by

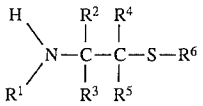

$R^1$=alkyl of 1 to 5 carbons, aryl, alkylacyl of 1 to 5 carbons, H or arylacyl;
$R^2$, $R^3$, $R^4$, $R^5$=H, alkyl of 1 to 4 carbons or $COR^7$;
$R^6$=H or alkyl of 1 to 5 carbons,
$R^7$ =OH, NHR-$^8$, $NR^8R^9$ or O-$R^{10}$ where $R^{10}$ is an alkyl of 1 to 5 carbons; and
R8, R9=H or alkyl of 1 to 5 carbons; or
$R^1$ and $R^6$ taken together represent one to three methylene groups bridging the nitrogen and the sulfur.

2. The photographic recording material of claim 1, wherein said compound is at least one of dialdehyde or dialdehyde bisulfite.

3. The photographic recording material of claim 1, wherein said compound is cysteine or 3-thiazolidine-4-carboxylic acid.

4. The photographic recording material of claim 1, further comprising at least one dye chosen from Formula II and Formula III is used as a green-sensitizing dye Formula II

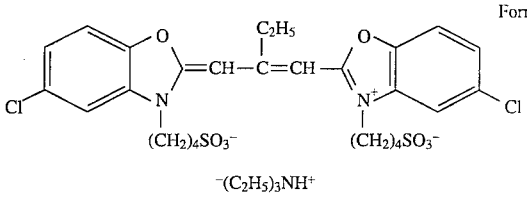

Formula III

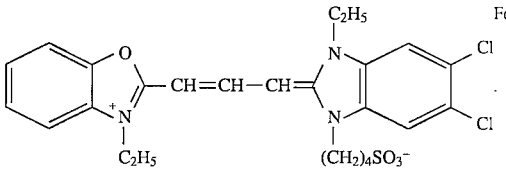

5. The photographic recording material of claim 4, characterized in that both of the dyes of Formula II and Formula III are used as green-sensitizing dyes.

* * * * *